US006964392B1

(12) United States Patent
Matsunaga

(10) Patent No.: US 6,964,392 B1
(45) Date of Patent: Nov. 15, 2005

(54) VARIABLE STRIP TENSIONER

(76) Inventor: Douglas S. Matsunaga, 9301 W. Bernice St., Schiller Park, IL (US) 60176

( * ) Notice: Subject to any disclaimer, the term of this patent is extended or adjusted under 35 U.S.C. 154(b) by 48 days.

(21) Appl. No.: 10/602,443

(22) Filed: Jun. 24, 2003

(51) Int. Cl.[7] ..... B65H 23/188

(52) U.S. Cl. ..... 242/419.4; 242/530.1; 226/195

(58) Field of Search ..... 242/419.3, 419.4, 242/530.1, 530.3, 548, 615.4; 226/195, 196

(56) References Cited

U.S. PATENT DOCUMENTS

| | | | | |
|---|---|---|---|---|
| 2,775,151 | A | 12/1956 | Schumacher | |
| 3,061,226 | A | 10/1962 | Kegg | |
| 3,098,620 | A * | 7/1963 | Carstens | 242/419.4 |
| 3,380,686 | A * | 4/1968 | Gaudin | 242/419.3 |
| 3,386,679 | A | 6/1968 | Foulon et al. | |
| 3,559,862 | A * | 2/1971 | Jablin et al. | 226/195 |
| 3,672,595 | A * | 6/1972 | Jablin et al. | 242/419.4 |
| 3,735,937 | A * | 5/1973 | Plantard | 226/195 |
| 3,771,738 | A * | 11/1973 | Abbey | 226/195 |
| 3,854,672 | A | 12/1974 | Tilban | |
| 3,863,858 | A * | 2/1975 | Cauffiel et al. | 242/419.4 |
| 4,093,140 | A * | 6/1978 | Matsunaga | 242/530.1 |
| 4,270,684 | A * | 6/1981 | Cauffiel | |
| 4,347,723 | A * | 9/1982 | Bradlee | 242/530.1 |
| 4,508,282 | A * | 4/1985 | Eiting | 242/419.4 |
| 5,007,272 | A | 4/1991 | Matsunaga et al. | |
| 5,069,427 | A * | 12/1991 | Umlauf | |
| 5,265,817 | A * | 11/1993 | Gaudin | 226/195 |
| 5,722,577 | A * | 3/1998 | Simpson | 226/195 |
| 6,599,224 | B2 * | 7/2003 | Magnani | |

* cited by examiner

*Primary Examiner*—William A. Rivera

(57) ABSTRACT

A tensioner for use in a coil slitting line includes segmented resistance surfaces with a plurality of actuators for urging the resistance surfaces against the slit strips to cause a different tension to be imparted to different strips.

9 Claims, 10 Drawing Sheets

VARIABLE STRIP TENSIONER

FIELD OF THE INVENTION

The invention relates to a tensioning device to be used in a metal coil slitting line.

BACKGROUND OF THE INVENTION

Steel slitting lines for slitting coiled steel into thinner strips usually include a tensioning device, or tensioner, interposed between the slitter and the recoiler, or rewinder. The tensioner is used to impart tension to the strips of steel as they are recoiled in order to ensure that the coils are tightly wrapped. Such tensioners apply a single compressive force across all the strips with a pair or more of rollers or frictional engagement surfaces that span the entire width of both sides of the parallel strips to cause the recoiler to pull the strips through the tensioner, thereby tensioning the strips of steel such as described in U.S. Pat. No. 5,007,272 to Matsunaga et al.

A common problem encountered during the slitting and rewinding operation using this type of tensioner is that the strips usually do not rewind at the same tangential speed on the recoiler. As discussed in U.S. Pat. No. 3,854,672 to Tilban, U.S. Pat. No. 3,386,679 to Foulon et al., and U.S. Pat. No. 3,061,226 to Keg, this problem occurs because the varying thickness of the original coiled steel across the sheet causes the diameters of the resultant rewound strips to increase at differing rates when rewound at the same rotational speed upon the recoiler. For example, when a thicker inner strip rewinds at the same rotational speed as a thinner outer strip, the diameter of the recoiled thicker strips will increase faster than the diameter of the thinner outer strips. When this happens, the smaller diameter outer strips will move at a slower tangential speed than the larger diameter inner strips. These outer strips moving at the slower tangential speeds create varying sagging sections, or loops, between the slitter and the tensioner that grow as the coil is fed through the line.

To overcome this problem, it is known for a looping pit to be located under where the loops sag. However, the loops that would be produced by a complete coil often exceed the depth of loop pit that is economically practical to build. Therefore, when the slower loops begin to drag on the pit floor, the line has to be stopped so that the outer strips may be cut and rewound to take up the slack. An alternative is to place spacers in the smaller diameter coils at intermittent times to increase their diameters. Either method causes delays in the slitting process that increase the cost and decrease the productivity of the process. Therefore, it would be desirable to eliminate or reduce the variation in tangential rewinding speeds across a group of slit strips in order to eliminate the need to interrupt the slitting process mid-coil.

SUMMARY OF THE INVENTION

The tensioner of this invention includes a pair of opposing engagement surfaces spanning either side of the pass line in a slitting process for coiled sheet material. One of the engagement surfaces is divided into a plurality of segments such that each slit strip is engaged by at least one of the segments. When the material is passed through the tensioner, the segmented engagement surface is shifted to compress the strip material against the opposing engagement surface as it is pulled through the tensioner. The segments of the segmented engagement surface travel independently of each other to allow each segment to be urged against a strip with selected varying pressure to produce different tensions in the strips as they are rewound.

An object of this invention is to provide a way of causing the strips in a slitting line to rewind at approximately the same tangential velocity.

BRIEF DESCRIPTION OF THE DRAWINGS

These and other aspects of the invention will be apparent from the following description, with reference to the accompanying drawings, in which.

DETAILED DESCRIPTION

Figure 1:
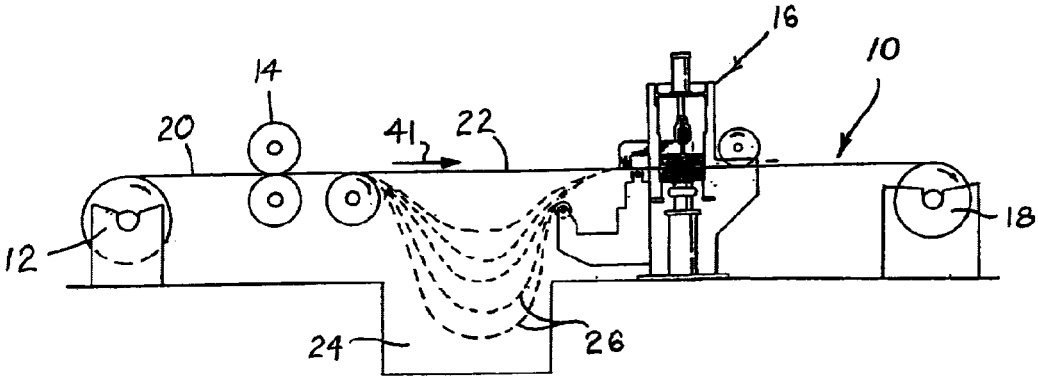
FIG. 1 shows the tensioner of this invention in a conventional slitting line.
Figure 2:
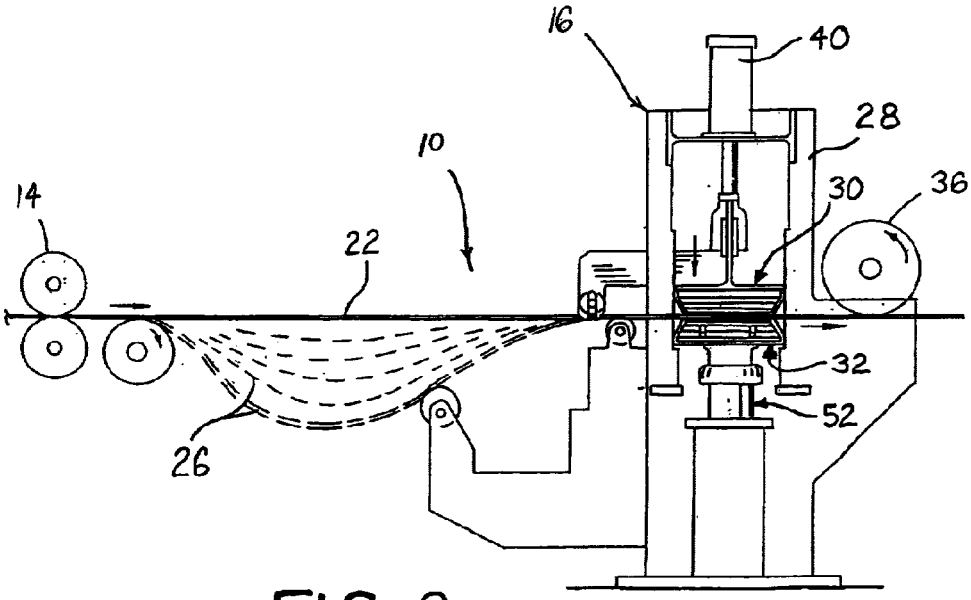
FIG. 2 shows the tensioner of FIG. 1.
Figure 3:
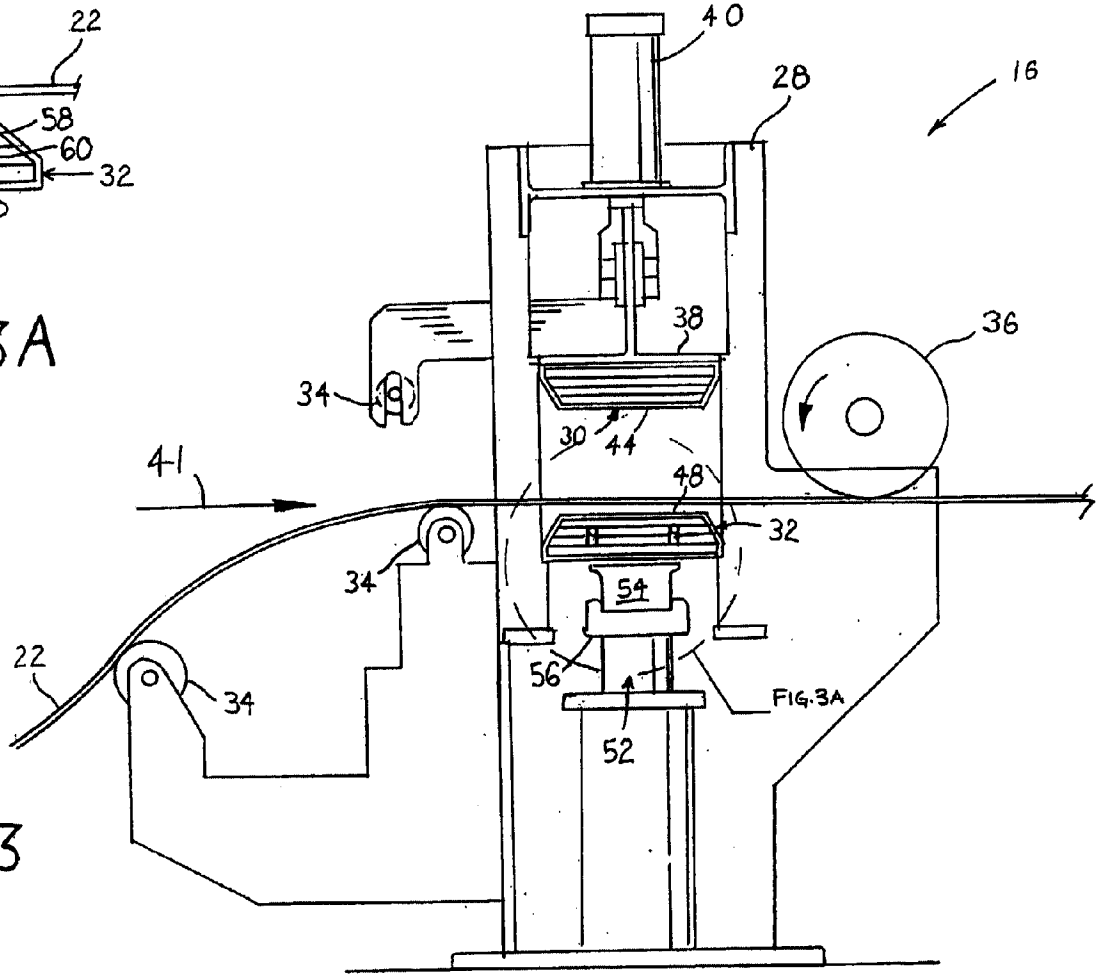
FIG. 3 is a cross sectional view of the tensioner with the engagement surfaces disengaged from the strip material as seen along the line 3—3 of FIG. 5.
Figure 3A:
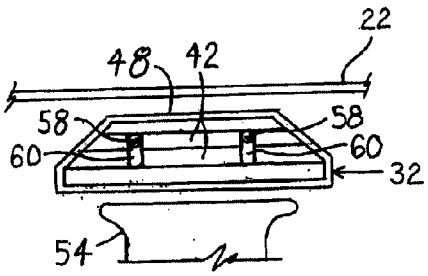
FIG. 3A is a close up detail of the indicated portion of FIG. 3.
Figure 4:
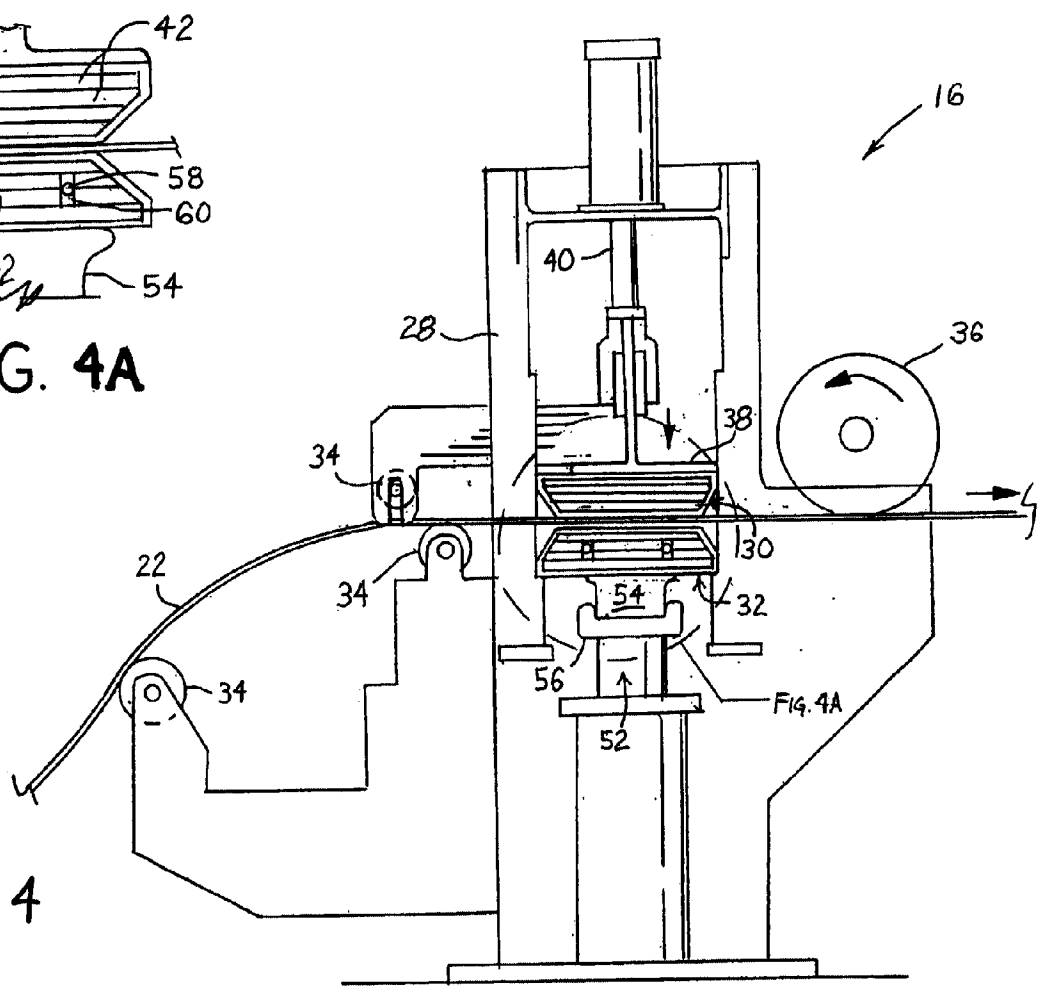
FIG. 4 is a cross-sectional view of the tensioner with the engagement surfaces engaged on the strip material as seen along the line 4—4 of FIG. 6.
Figure 4A:
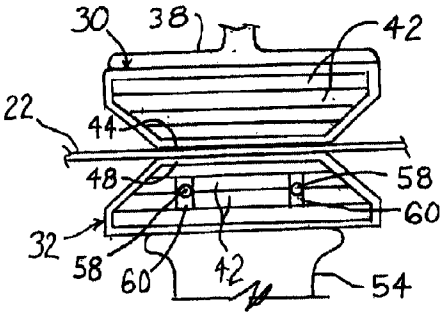
FIG. 4A is a close up detail of the indicated portion of FIG. 4.
Figure 5:
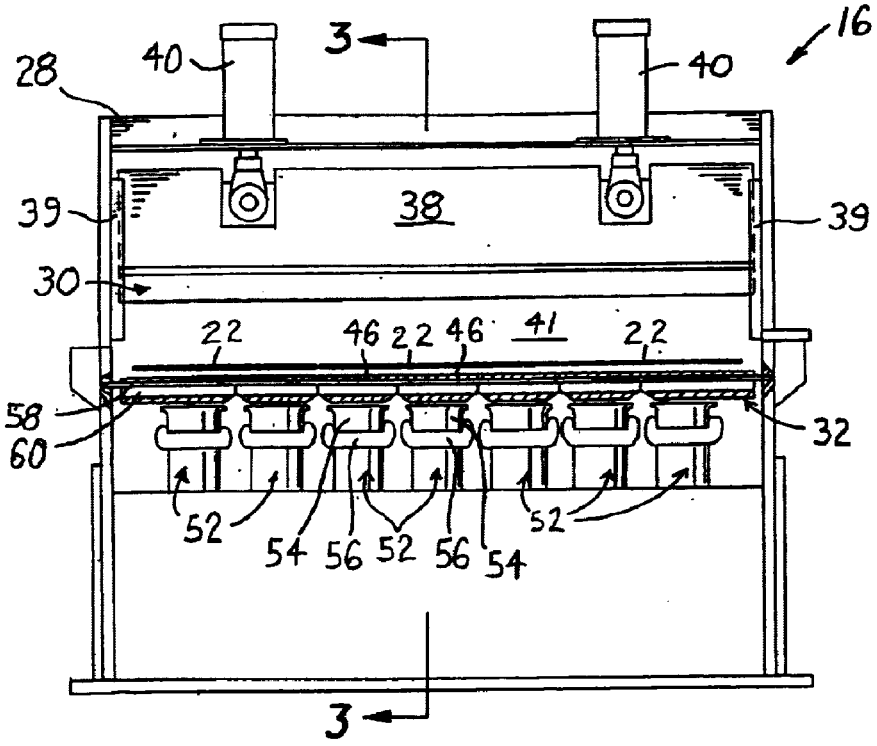
FIG. 5 is an end view of the tensioner with the engagement surfaces shown in sectional form and open.
Figure 6:
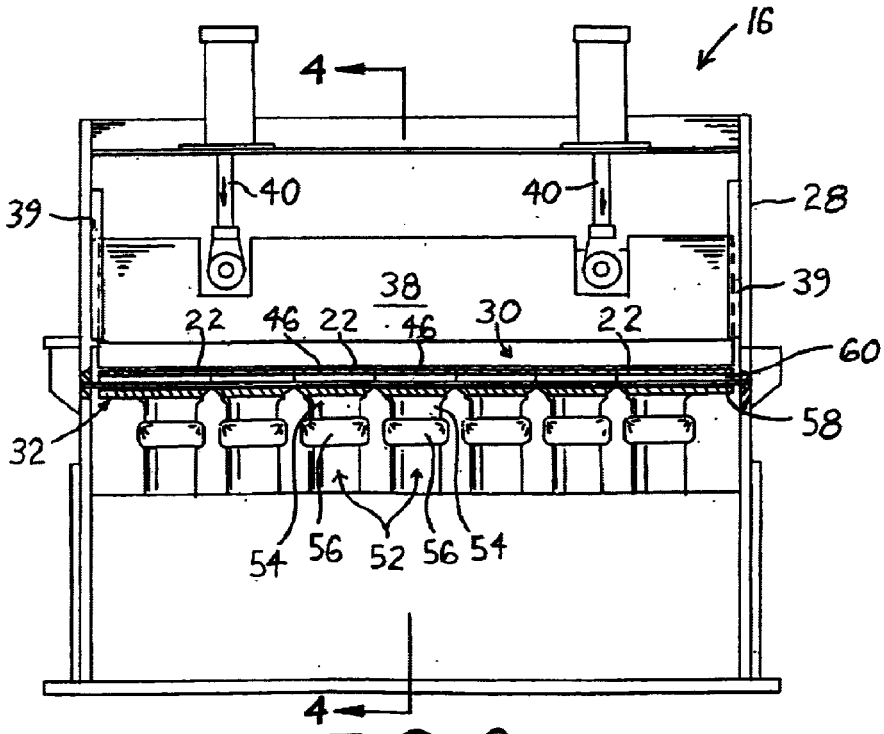
FIG. 6 is an end view of the tensioner with the engagement surfaces shown in sectional form closed.

Referring now to the drawings, and specifically FIG. 1, a slitter line 10 includes an uncoiler 12, a slitter 14, a tensioner 16, and a recoiler, or rewinder, 18 along a pass line 41, the configuration of which is all well known except for the new tensioner as described herein. Coiled sheet steel 20 is uncoiled by uncoiler 12 and fed through slitter 14, which cuts the steel longitudinally into narrow strips 22. Strips 22 then pass over a looping pit 24 and are pulled through tensioner 16 by recoiler 18, where the strips are rewound into separate coils.

As seen in FIGS. 2–6, tensioner 16 includes a frame 28 carrying an upper friction block 30 and a lower friction block 32 between which strips 22 pass. Guide rollers 34 direct strips 22 into the space between upper friction block 30 and lower friction block 32. Pass line roll 36 establishes a pass line elevation as the strips 22 are pulled toward recoiler 18. Upper and lower friction blocks 30, 32 have an open position, shown in FIGS. 3 and 5, and a closed position, shown in FIGS. 4 and 6. In their open position, upper and lower friction blocks 30, 32 allow the strips 22 to pass without interference. In their closed position, friction blocks 30, 32 are urged against strips 22 to frictionally restrain them as they are wound about the recoiler spindles, thereby causing the strips to be pulled taught as they are rewound.

Upper friction block 30 includes a unitary beam 38 carried by a pair of telescoping cylinders 40 within guides 39. Beam 38 spans the width of strips 22 across their pass line 41. The strip material contact side of friction block 30 further includes laminated layers of plywood 42 sandwiched between the beam 38 and a wear surface 44 along the length of the beam. Wear surface 44 is preferably felt, which picks up detrimental debris from the strips 22 as they pass and may be easily replaced at it becomes worn. Cylinders 40 shift the beam along a fixed path of travel between an open position spaced above the strips 22 and a closed position adjacent the strips in which wear surface 44 contacts the strips.

Lower friction block 32 is divided into a plurality of transversely spaced horizontal segments or pads 46 spanning the pass line 41 under the strips 22. Each pad 46 is made of laminated layers of plywood 42 covered with a felt contact surface or wear pad 48. Preferably, wear pad 48 is a single strip of felt spanning all the pads 46. Plywood and felt is preferred for use in the upper and lower friction blocks 30, 32 due to their relative light weight and economy, but other materials could also be used. Felt wear pads 48 may also be easily attached and removed from the plywood 42 for replacement. Each segment 46 is located over an actuator column 52, which includes a capital 54 carried by an airbag 56, and is supported when the lower friction block 32 is in its open position by a pair of rods 58 which span through transversely aligned vertically slotted holes 60 in all the segments. Rods 58, in conjunction with felt wear surface 48 across segments 46, allow all the segments of lower friction block 32 to be removed and installed as a single unit when necessary to perform maintenance to the lower friction block. Both the upper and lower friction blocks 30, 32 may be removed from tensioner frame 28 to allow maintenance to be performed when not in the tensioner 10.

When tensioner 16 is open with blocks 30, 32 in their open position, upper friction block 30 is raised and airbags 56 are deflated, thereby lowering capitals 54 under segments 46 of lower friction block 32. When capitals 54 are lowered, segments 46 are carried by rods 58, which are fixedly attached to frame 28. When tensioner 16 is closed with blocks 30, 32 in their closed position, upper friction block 30 is lowered to a fixed position next to and preferably just in contact with strips 22. Airbags 56 are inflated thereby raising capitals 54 and urging pads 46 off of rods 58 and up into contact with strips 22, compressing the strips between the blocks. Slotted holes 60 provide enough in play in segments 46 with respect to rods 58 to allow each segment to shift into contact with each individual strip 22 regardless of the strip's thickness to urge each strip against upper friction block 30.

Figure 7:
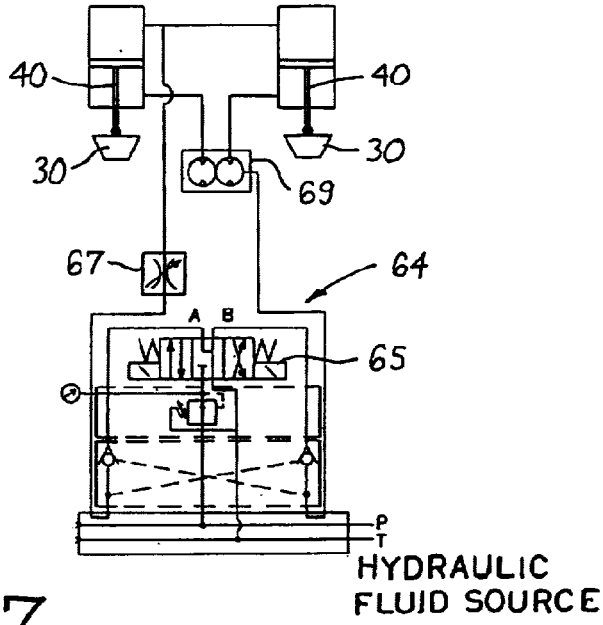
FIG. 7 is a schematic diagram of the hydraulic actuator system for the unitary friction block of the tensioner.
Figure 8:
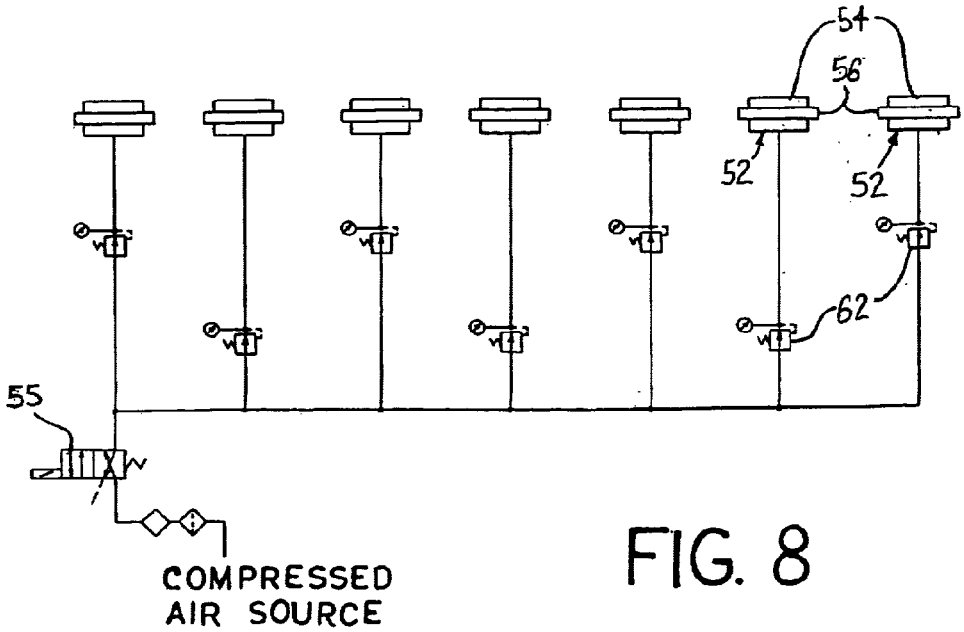
FIG. 8 is a schematic diagram of the pneumatic actuator system for the segmented friction block of the tensioner.

As depicted in FIGS. 7 and 8, each airbag 56 is individually controlled with known pressure control apparatus 62 so that each airbag can maintain a different air pressure. In the depicted embodiment, lower friction block 32 is divided into seven segments 46, each having its own actuator column 52, airbag 56, capital 54, and air pressure regulator 62. Compressed air is supplied to each airbag 56 from a compressed air source through main valve 55. Upper friction block 30 is actuated by a pair of hydraulic cylinders 40 that are controlled with appropriate known control apparatus 64 including hydraulic valve 65, needle valve 67, and flow divider 69, such that the cylinders shift upwardly and downwardly together in tandem. Although the preferred embodiment described herein uses a unitary top friction block urged against a segmented lower friction block, both the upper and lower friction blocks could also be segmented and have individual actuators, or the segmented block could be placed above the strips and the unitary block below. The arrangement could also substitute known compression rollers or other suitable known compression apparatus for the friction blocks described.

In use, tensioner 16 is located along the pass line 41 of the material between slitter 14 and recoiler 18. Slit strips 22 are threaded through tensioner 16 between upper friction block 30 and lower friction block 32 in their open positions and wound around recoiler spindles in any manner well known in the art. Friction blocks 30, 32 are then shifted to their closed positions by lowering upper friction block through control apparatus 64 to its preset position over the top side of strips 22 and inflating airbags 56 to urge pads 46 against the lower side of strips 22 to clamp each strip between at least one segment 46 and block 30 at a pre-determined pressure. Once the slitting line is started, the pressure in each column actuator 52 is varied by the operator through its associated regulator 62 to adjust the tension of each individual strip 22 in order to generally equalize the winding rate of the several strips.

To equalize the recoiling rate of the slit strips, the thicker center strips must be wound tighter—i.e., at a greater tension—than the thinner outer strips so that the growth rate of the rewound diameters of the thicker strips is generally the same as the growth rate of the diameters of the thinner strips. By equalizing the growth rate of the various rewound coil diameters, the tangential speeds of the strips remain the same across the width of the sheet. Thereby, the rate of unwinding and rewinding can be equalized on both ends of the process and none of the strips has a sag loop that grows in relation to the other strips' sag loops. When a coil has been fully slit and the strips rewound, the friction blocks are opened to allow another coil's strips to be threaded through the pass line.

In FIGS. 9–14, another tensioner 100 is depicted. Tensioner 100 includes a lower segmented friction block 32 and an upper rolling compression member 102 between which slit strips 22 are pulled in the same manner as hereinbefore described. Each pad 46 of segmented friction block 32 is individually compressed against strips 22 by its own actuator column 52 as hereinbefore described. Rolling compression member 102 is raised away from and lowered to contact the top of strips 22 by a pair of extensible cylinders 110 on either end of the rolling compression member carried by the tensioner's frame 112. When segmented friction block 32 and rolling compression member 102 are open, each are vertically spaced from the bottom and top sides, respectively, of the strips 22. When segmented friction block 32 and rolling compression member 102 are closed, strips 22 are compressed between them, with each pad 46 of segmented friction block 32 urged upwardly against the bottom side of the strips by its actuator column 52. The vertical movement of cylinders 110 is controlled with the same known control apparatus 64 as hereinbefore described. The vertical movement of each pad 46 is also individually controlled with an airbag 56 and pressure control apparatus 62 as hereinbefore described for the embodiment of FIGS. 1–8.

Rolling compression member 102 includes a plurality of belts 104 trained around aligned pairs of pulleys 106, 108 journalled to parallel rods 114, 116, a belt guide 118 between the pulleys, and a heat exchanger 120. Each belt 104 extends around a pair of aligned pulleys 106, 108 such that the belt may rotate in the same direction as the strips 22. Pulleys 106 are journalled along the length of rod 114, and pulleys 108 are journalled along the length of rod 116 to transversely span the width of the strips' pass line 41. At least one belt 104 is associated with every strip. Rods 114, 116 are carried on either end by a carriage head 118 connected to one of cylinders 110 such that the rods shift vertically in tandem when the cylinders are extended or retracted. With pulleys 106, 108 freely rotating about rods 114, 116, each belt 104 can rotate at the same speed as strips 22 passing along the pass line 41 when rolling compression member 102 is lowered against the passing strips. Belt guide 118 transversely spans the pass line 41 between pulleys 106, 108 and extends below the pulleys. Belt guide 118 guides the path of belts 104 and presses belts 104 against strips 22 when the tensioner is closed. Heat exchanger 120 is adjacent belt guide 118 opposite the pass line 41. Heat exchanger 120 circulates coolant through tubing 122 to remove heat caused by the friction between belts 104 and belt guide 118 when the guide urges the belts against the moving strips 22 passing through tensioner 100.

Figure 13:
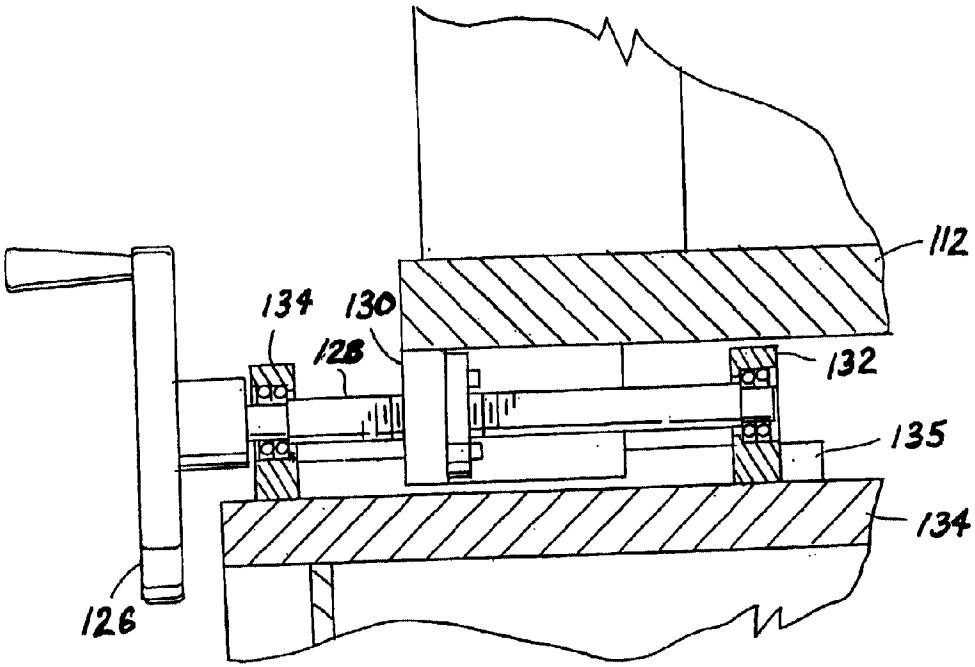
FIG. 13 is a detailed cross section of the indicated adjustment wheel circled in FIG. 10; and, FIG. 14 is a top plan view of the tensioner shown in FIG. 9.

An adjustment mechanism 124, best seen in FIG. 13, is used to transversely shift segmented friction block 32 and rolling compression member 102 laterally across pass line 41. Adjustment mechanism 124 includes a crank wheel 126 on the end of a jack screw 128 threaded through a thread block 130. Thread block 130 is affixed to tensioner frame 112, and jack screw is journalled between a pair of pillow blocks 132 affixed to a base 134 for tensioner frame 112. Block 130 slidably carries tensioner frame 112 supported on tracks 135. When crank wheel 126 is turned, jack screw 128 causes thread block 130 to shift along the jack screw, which causes tensioner frame 112 to shift laterally back or forth across the pass line along tracks 135. Adjustment mechanism 124 thereby allows the pads 46 of segmented friction block 32 to be aligned with different strips 22.

Figure 9:
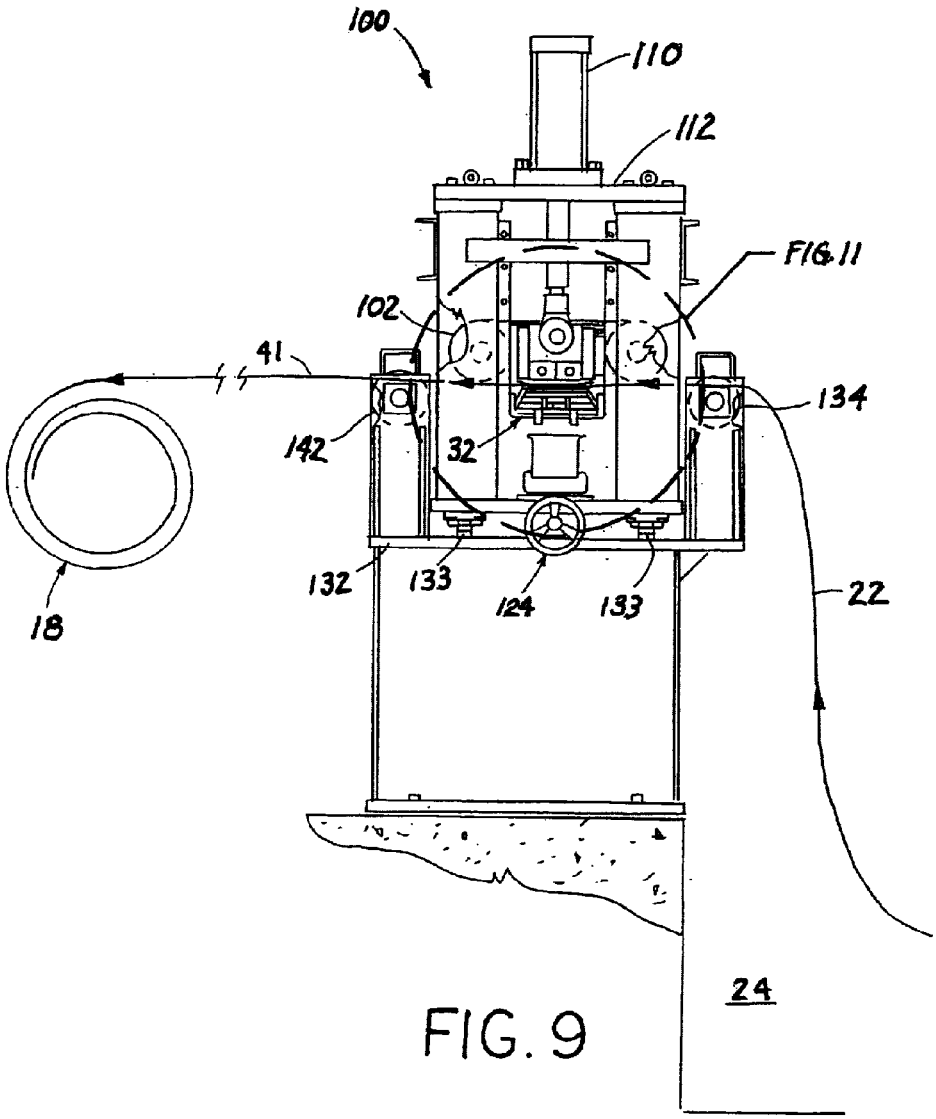
FIG. 9 is a cross sectional view of a second tensioner.
Figure 10:
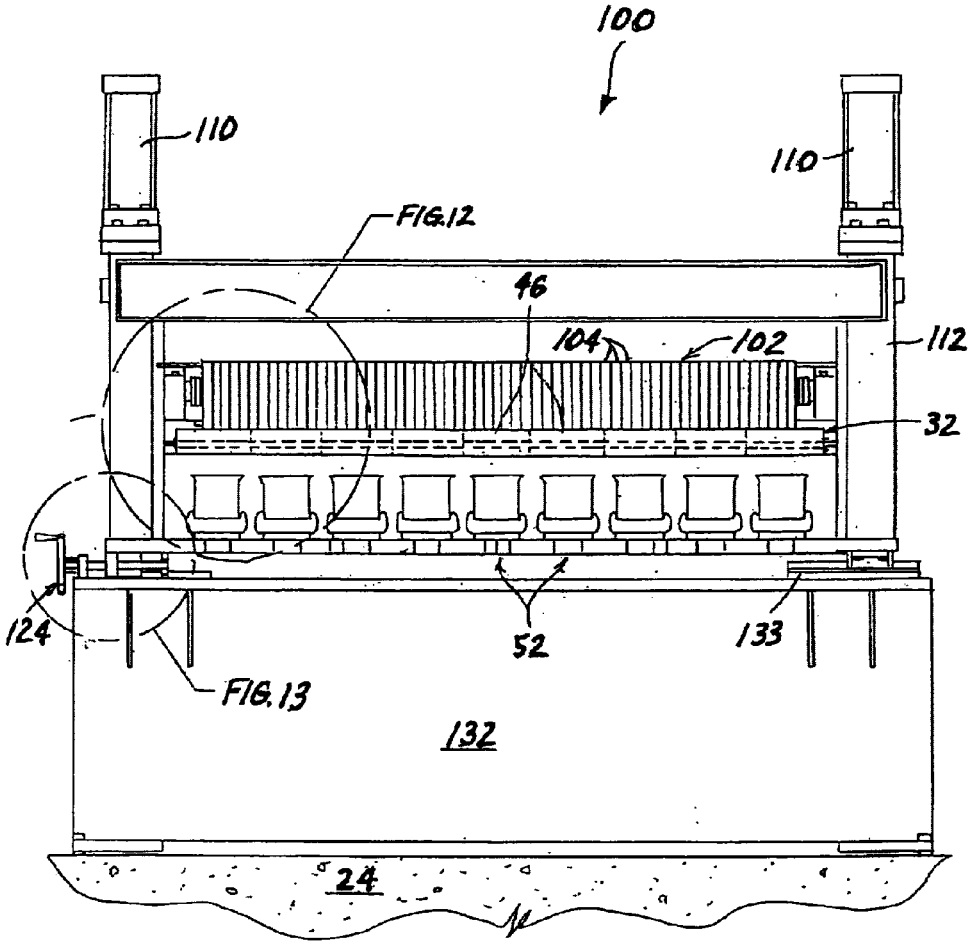
FIG. 10 is an end view of the tensioner shown in FIG. 9.
Figure 11:
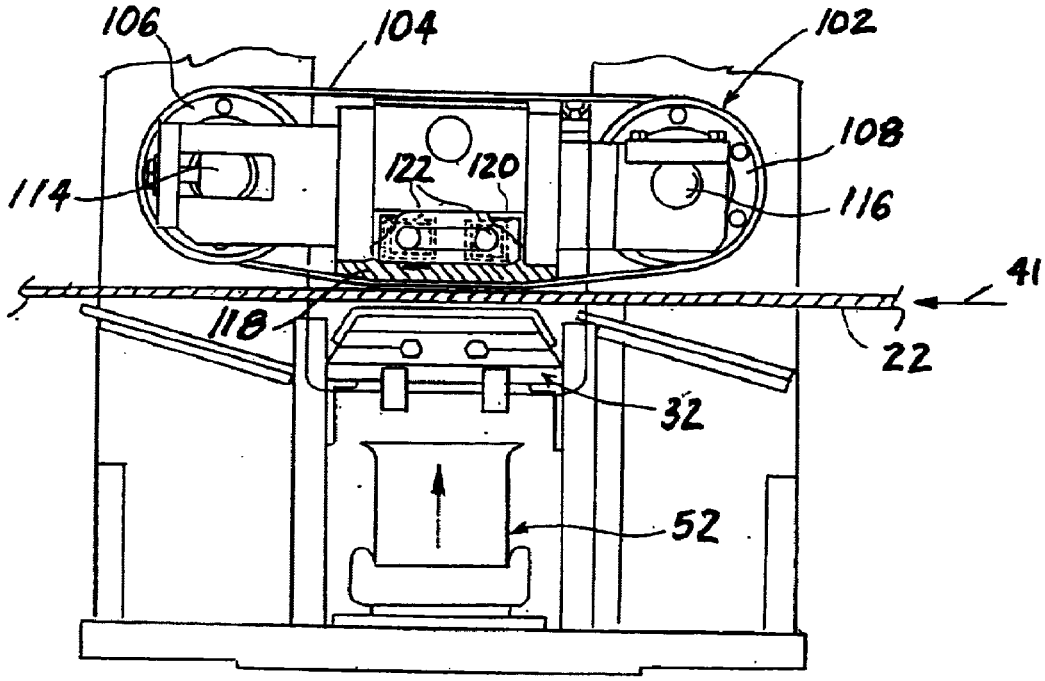
FIG. 11 is a detailed cross sectional view of the indicated circled portion indicated in FIG. 9.
Figure 12:
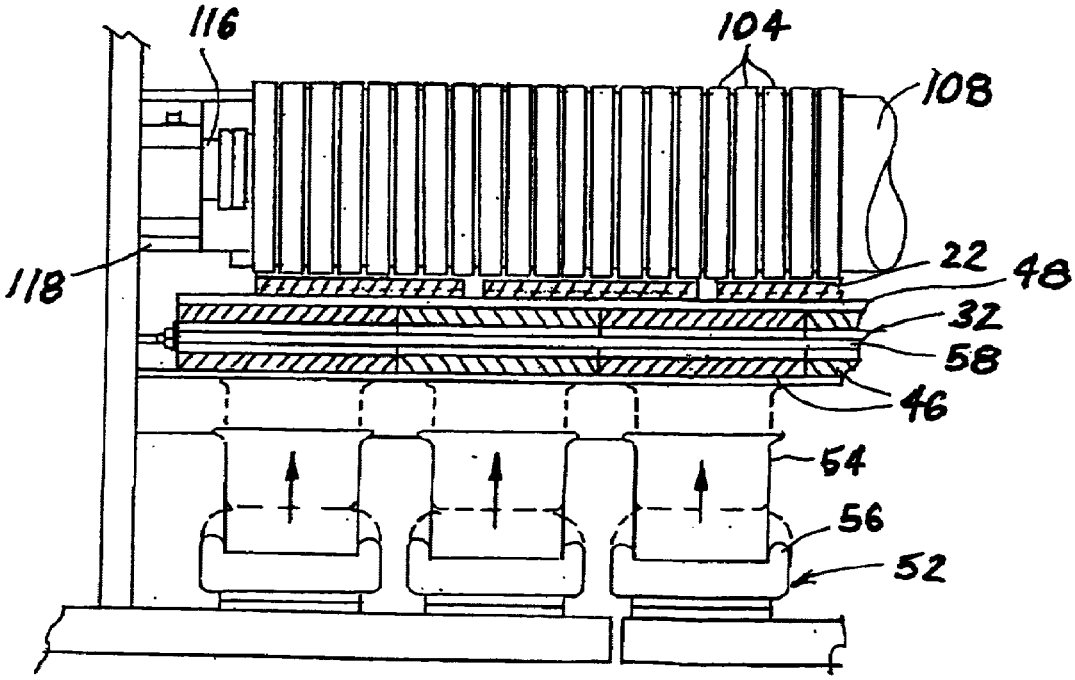
FIG. 12 is a detailed end view of the indicated circled portion indicated in FIG. 10.
Figure 14:
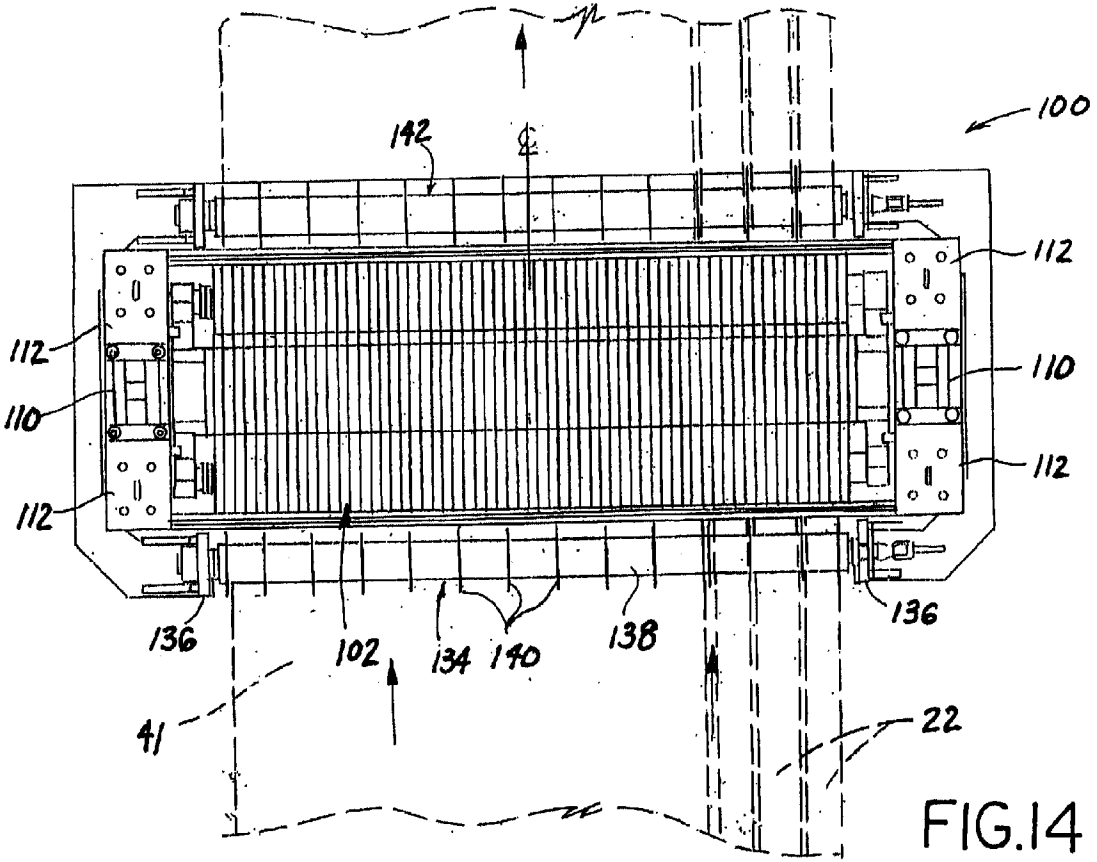

A strip guide 135, best seen in FIGS. 9 and 14, is located across the entryway of pass line 41 into tensioner 100. Strip guide 135 includes a pair of bearing blocks 136 carried by frame 112 on opposite sides of the pass line 41, a roller 138 extending between the bearing blocks and journalled thereto on either end. A plurality of separator disks 140 are carried by the roller. Separator disks 140 extend radially outward from roller and are laterally spaced there along. Separator disks are positioned between individual strips 22 as they enter tensioner 100 to guide the strips into the tensioner and to keep the strips separated as they pass through the tensioner. A second exit strip guide 142, which includes similar parts for similar functions as entryway strip guide 135, is located across the exit of pass line 41 out of tensioner 100 to provide added guidance for strips 22 as they are pulled to the recoiler. Strip guides 135, 142 are carried by base 134 and do not shift laterally with tensioner frame 112 when adjusted with adjustment mechanism 124.

In use, strips 22 are pulled through tensioner 100 between rolling compression member 102 and segmented friction block 32 by recoiler 18 as hereinbefore described. Before starting the line, separator disks 140 are placed between adjacent strips 22, and tensioner 100 is laterally adjusted with adjustment mechanism 124 to align pads 46 with strips 22. Rolling compression member 102 is then lowered by cylinders 110 to a fixed position adjacent the top side of strips 22, and pads 46 are individually urged against the bottom side of strips 22 to compress each strip against belts 104. As hereinbefore described, each strip 22 is compressed at its own pressure to adjust and equalize the recoiling rate of the strips across the pass line 41. Belts 104 on rolling compression member 102 roll along strips 22 at the same tangential speed while compressing the strips against the fixed pads 46 of segmented friction block 32, thereby preventing scratching or abrasion of the top surface of the strips as they pass through tensioner 100. Coolant is circulated through heat exchanger 120 during operation to cool belt guide 118. After the strips are completely re-wound on the recoiler, airbags 56 are deflated. When another set of strips are to be threaded through tensioner 100, rolling compression member 102 is raised to allow the strips to be threaded between segmented friction block 32 and the rolling compression member.

The above description is only meant to exemplify the invention to enable others to reproduce it. The description is not intended to be a limitation from other minor and obvious variations on the embodiments described, all of which variations are expressly included herein.

What is claimed is:

1. A tensioner for selectively tensioning individual parallel strips of sheet material traveling along a pass line from a slitter to a recoiler, said tensioner interposed across said pass line and about said strips between said slitter and recoiler, said tensioner comprising:

a first engagement member transversely spanning one side of said strips;

a second engagement member transversely spanning the opposite side of said strips, said second engagement member formed into a plurality of individual segments secured against movement along said pass line with at least one of said segments aligned with each of said strips;

an actuator associated with each said segment of said second engagement member, each actuator for individually urging its said segment toward said first engagement member into a closed position to selectively compress each strip between said first and second engagement members.

2. The tensioner of claim 1 and a support for said segments to allow each segment to shift independently of the other said segments toward said first engagement member.

3. The tensioner of claim 2 wherein each segment is shiftable between an open position vertically spaced below said strips and said closed position contacting said strips.

4. A tenioner for selectively tensioning individual parallel strips of sheet material traveling along a pass line from a slitter to a recoiler, said tensioner interposed across said pass line and about said strips between said slitter and recoiler, said tensioner comprising:

a first engagement member transversely spanning one side of said strips;

a second engagement member transversely spanning the opposite side of said strips, said second engagement member formed into a plurality of individual segments with at least one of said segments aligned with each of said strips;

an actuator associated with each said segment of said second engagement member, each actuator for individually urging its said segment toward said first engagement member into a closed position to selectively compress each strip between said first and second engagement members, and a support for said segments to allow each segment to shift independently of the other said segments toward said first engagement member, each segment being shiftable between an open position vertically spaced below said strips and said closed position contacting said strips, said segments having transversely aligned holes through said segments, a fixed rod extending through said holes with a clearance, whereby each segment is supported by a said actuator when said segment is in its said closed position and each segment is carried by said rod when in its said open position.

5. The tensioner of claim 4 wherein said first engagement member is shiftable between a vertically spaced position above said strips and an engagement position in contact with said material.

6. A tensioner for selectively tensioning individual parallel strips of sheet material traveling along a pass line from a slitter to a recoiler, said tensioner comprising:

a first engagement member for transversely spanning said pass line;

a second engagement member opposed to said first engagement member for transversely spanning said pass line, said second engagement member including segments transversely alignable with said strips and secured against movement along said pass line as said strips travel along the pass line;

a plurality of actuators to selectively urge said segments toward said first engagement member for selectively compressing said strips between said first and second engagement members.

7. The tensioner of claim 6 wherein said first engagement member includes a plurality of second segments for rotatively engaging said strips, each said second segment aligned with a said strip.

8. The tensioner of claim 7 wherein said first segments are rotatively fixed for frictional engagement with said strips.

9. A method of recoiling parallel strips of slit coils having a plurality of thicknesses comprising the steps:

a) passing said strips along a pass line between opposing engagement members carried by a tensioner, one of said engagement surfaces being segmented with at least one of said segments secured against movement along said pass line and aligned with each of said strips; and, b) selectively compressing each said strip between the other of said engagement members and said aligned segment to apply a selected tension to each strip as it is wound upon the recoiler.

* * * * *